US009086231B2

(12) United States Patent
Xu et al.

(10) Patent No.: US 9,086,231 B2
(45) Date of Patent: Jul. 21, 2015

(54) REGENERATIVE REFRIGERATOR

(75) Inventors: Mingyao Xu, Tokyo (JP); Takaaki Morie, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 628 days.

(21) Appl. No.: 13/369,530

(22) Filed: Feb. 9, 2012

(65) Prior Publication Data

US 2012/0204579 A1 Aug. 16, 2012

(30) Foreign Application Priority Data

Feb. 15, 2011 (JP) ..... 2011-029308

(51) Int. Cl.

*F25B 9/00* (2006.01)
*F25B 9/14* (2006.01)
*F25B 9/10* (2006.01)

(52) U.S. Cl.

CPC . *F25B 9/145* (2013.01); *F25B 9/10* (2013.01); *F25B 2309/1408* (2013.01); *F25B 2309/1415* (2013.01); *F25B 2309/1418* (2013.01)

(58) Field of Classification Search

CPC ..... F25B 9/10; F25B 9/14; F25B 9/145; F25B 2309/1415; F25B 2309/1418; F25B 2309/1412

USPC ..... 62/6; 60/516–531

See application file for complete search history.

(56) References Cited

U.S. PATENT DOCUMENTS

| | | | | |
|---|---|---|---|---|
| 3,692,095 | A * | 9/1972 | Fleming | 165/4 |
| 3,692,099 | A * | 9/1972 | Nesbitt et al. | 165/10 |
| 4,359,872 | A | 11/1982 | Goldowsky | |
| 5,381,666 | A * | 1/1995 | Saho et al. | 62/47.1 |
| 2009/0000313 | A1 * | 1/2009 | Bin-Nun | 62/6 |

FOREIGN PATENT DOCUMENTS

| | | |
|---|---|---|
| DE | 19924184 | 11/2000 |
| JP | 63-54577 | 3/1988 |
| JP | 03-117855 | 5/1991 |
| JP | 07-318181 | 12/1995 |
| JP | 11-037581 | 2/1999 |
| JP | 11-037582 | 2/1999 |
| JP | 2006-524307 | 10/2006 |
| JP | 2010-159888 | 7/2010 |
| WO | WO2004/094927 | 11/2004 |

* cited by examiner

*Primary Examiner* — Cassey D Bauer
*Assistant Examiner* — Joseph Trpisovsky
(74) *Attorney, Agent, or Firm* — IPUSA, PLLC

(57) ABSTRACT

A regenerative refrigerator includes a cylinder configured to cause a refrigerant gas to adiabatically expand; and a regenerator tube connected to the cylinder and including a partitioning member. The partitioning member partitions an internal space of the regenerator tube into a first space in which the refrigerant gas flows and a second space filled with a regenerator material formed of gas. The regenerator tube is configured to accumulate, in the regenerator material, cold generated in the cylinder with adiabatic expansion of the refrigerant gas. The area of exposure of the partitioning member to the second space is greater than the area of exposure of the partitioning member to the first space.

5 Claims, 10 Drawing Sheets

REGENERATIVE REFRIGERATOR

CROSS-REFERENCE TO RELATED APPLICATION

The present application is based upon and claims the benefit of priority of Japanese Patent Application No. 2011-029308, filed on Feb. 15, 2011, the entire contents of which are incorporated herein by reference.

BACKGROUND OF THE INVENTION

1. Field of the Invention

The present invention relates to a regenerative refrigerator that uses a refrigerant gas such as helium gas and has a regenerator containing a regenerator material.

2. Description of the Related Art

A regenerative refrigerator that uses a refrigerant gas such as helium gas and has a regenerator containing a regenerator material is used to attain a cryogenic temperature of approximately 4 K, for example. Further, refrigerators such as Gifford-McMahon (GM) refrigerators and pulse tube refrigerators are used as regenerative refrigerators.

The regenerative refrigerator performs refrigeration by causing a refrigerant gas to expand adiabatically and storing the cold (cold heat) generated at that time in a regenerator material. Therefore, the regenerative refrigerator includes a cylinder and a regenerator tube connected to the cylinder, and has a regenerator material for storing cold provided inside the regenerator tube.

The regenerator material needs to have high specific heat at cryogenic temperatures that are operating temperatures. In general, however, the specific heat of metal such as lead decreases sharply with a decrease in temperature at cryogenic temperatures lower than or equal to 15 K. Therefore, a magnetic regenerator material having higher specific heat than lead at temperatures lower than or equal to 15 K, such as HoCu2, is used as a regenerator material. However, the magnetic regenerator material, which has high magnetic susceptibility at 15 K or below, may generate magnetic noise. This makes it necessary to provide a magnetic shield around the regenerator tube, thus increasing the manufacturing cost.

On the other hand, helium, which is used as a refrigerant gas, has high specific heat at cryogenic temperatures that are operating temperatures. Therefore, a gas regenerator material formed of helium gas may be used as a regenerator material for cryogenic temperatures lower than or equal to 15 K. (See, for example, Japanese National Publication of International Patent Application No. 2006-524307.) Using a gas regenerator material formed of helium gas eliminates the necessity of providing a magnetic shield around the regenerator tube, and thus makes it possible to reduce manufacturing cost.

SUMMARY OF THE INVENTION

According to an aspect of the invention, a regenerative refrigerator includes a cylinder configured to cause a refrigerant gas to adiabatically expand; and a regenerator tube connected to the cylinder and including a partitioning member, the partitioning member partitioning an internal space of the regenerator tube into a first space in which the refrigerant gas flows and a second space filled with a regenerator material formed of gas, the regenerator tube being configured to accumulate, in the regenerator material, cold generated in the cylinder with adiabatic expansion of the refrigerant gas, wherein an area of exposure of the partitioning member to the second space is greater than an area of exposure of the partitioning member to the first space.

The object and advantages of the embodiments will be realized and attained by means of the elements and combinations particularly pointed out in the claims.

It is to be understood that both the foregoing general description and the following detailed description are exemplary and explanatory and not restrictive of the invention as claimed.

BRIEF DESCRIPTION OF THE DRAWINGS

Other objects, features and advantages of the present invention will become more apparent from the following detailed description when read in conjunction with the accompanying drawings, in which:

FIGS. 3A and 33 are enlarged cross-sectional views of a low-temperature-side second-stage regenerator tube according to the first embodiment, schematically illustrating a configuration of the low-temperature-side second-stage regenerator tube;

DETAILED DESCRIPTION OF THE PREFERRED EMBODIMENTS

As described above, using a gas regenerator material formed of helium gas eliminates the necessity of providing a magnetic shield around the regenerator tube, thus making it possible to reduce manufacturing cost. However, regenerative refrigerators using a gas regenerator material as a regenerator material for cryogenic temperatures as described above have problems as follows.

In the case where the regenerator tube has a hollow body, hermetically filled with a gas regenerator material formed of helium gas, provided inside the regenerator tube, a refrigerant helium gas flowing outside the hollow body inside the regenerator tube and the helium gas regenerator material inside the hollow body exchange heat through the wall of the hollow body.

At this point, since the coefficient of heat transfer of gas is higher for a gas having a higher flow velocity, the coefficient of heat transfer of the helium gas regenerator material filling in the hollow body, having a flow velocity of zero, is lower than the coefficient of heat transfer of the refrigerant helium gas having a flow velocity higher than zero. This results in low efficiency of heat transfer between the gas regenerator material and the refrigerant gas.

Further, the area of the interior surface of the hollow body is smaller than the area of the exterior surface of the hollow body. Accordingly, the contact area of the helium gas regenerator material and the hollow body is smaller than the contact area of the refrigerant helium gas and the hollow body. This also results in low efficiency of heat transfer between the gas regenerator material and the refrigerant gas.

The same problems also exist in the case of using a gas regenerator material formed of a gas other than helium gas.

According to an aspect of the present invention, it is possible to reduce the manufacturing cost of a regenerative refrigerator by using a gas regenerator material as a regenerator material for cryogenic temperatures and to improve the efficiency of heat transfer between a refrigerant gas and the gas regenerator material in the regenerative refrigerator.

According to an aspect of the present invention, a regenerative refrigerator is provided whose manufacturing cost is reduced by using a gas regenerator material as a regenerator material for cryogenic temperatures and in which the efficiency of heat transfer between a refrigerant gas and the gas regenerator material is improved.

A description is given, with reference to the accompanying drawings, of embodiments of the present invention.

[a] First Embodiment

Figure 1:
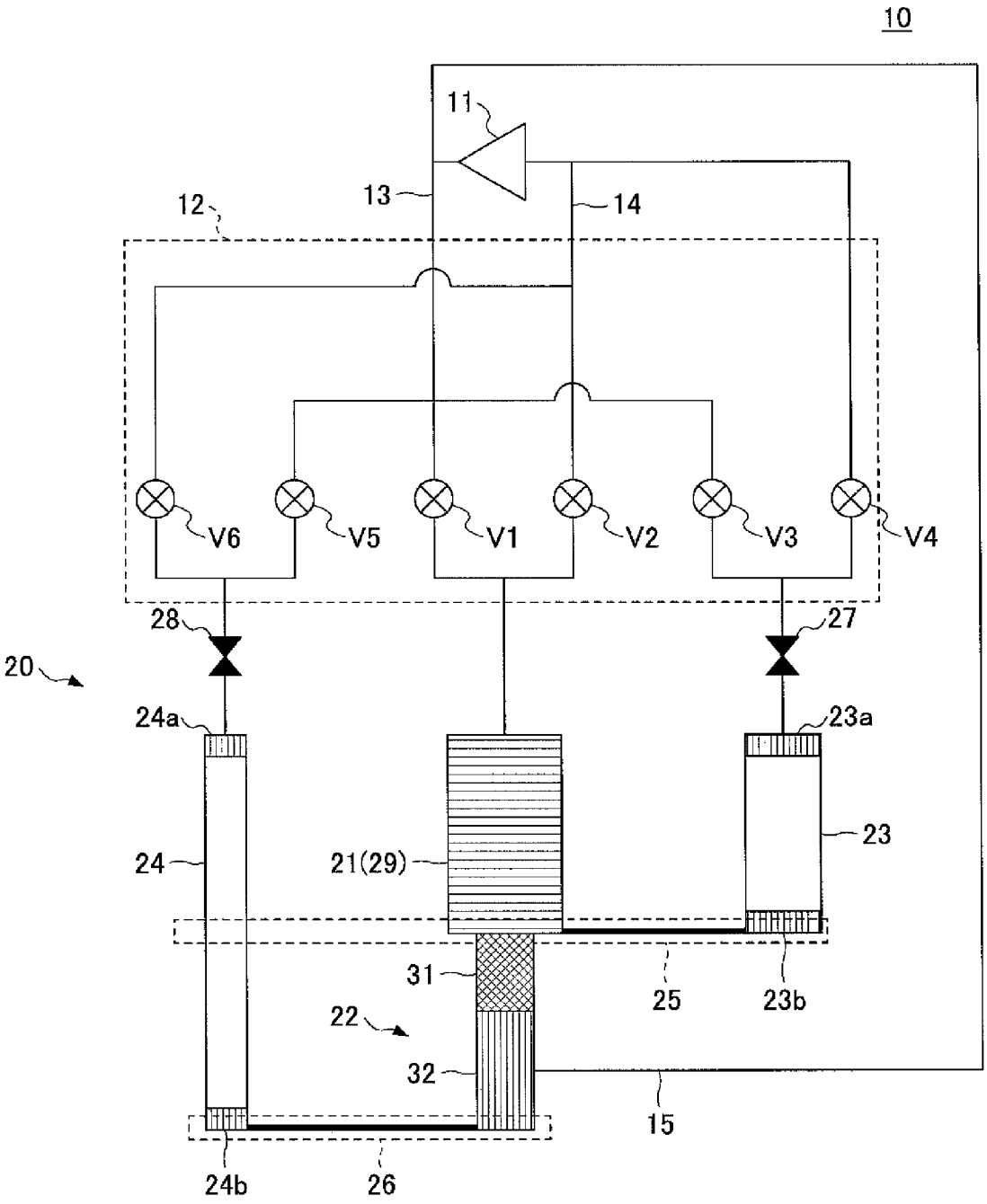
FIG. 1 is a schematic diagram illustrating a configuration of a pulse tube refrigerator according to a first embodiment.

A description is given, with reference to FIG. 1, of a pulse tube refrigerator according to a first embodiment. The pulse tube refrigerator according to this embodiment, which is an application of a regenerative refrigerator of the present invention to a pulse tube refrigerator, has a two-stage configuration suitable for attaining cryogenic temperatures of approximately a few K to approximately 20 K.

FIG. 1 is a schematic diagram illustrating a configuration of the pulse tube refrigerator according to this embodiment.

Referring to FIG. 1, a pulse tube refrigerator 10 according to this embodiment includes a compressor 11, a valve unit 12, and an expander 20. The expander 20 includes a first-stage regenerator tube 21, a second-stage regenerator tube 22, a first-stage pulse tube 23, a second-stage pulse tube 24, a first-stage cooling stage 25, a second-stage cooling stage 26, a first orifice 27, and a second orifice 28.

In FIG. 1, for facilitation of graphical representation, the first-stage cooling stage 25 and the second-stage cooling stage 26 are indicated by broken lines.

The compressor 11 includes a high-pressure pipe 13 on the outlet (discharge) side and a low-pressure pipe 14 on the intake side. The compressor 11 collects a refrigerant gas such as helium (He) gas from the expander 20 by taking in the refrigerant gas via the low-pressure pipe 14. Further, the compressor 11 supplies the expander 20 with the refrigerant gas by compressing the taken-in refrigerant gas and discharging the compressed refrigerant gas to the high-pressure pipe 13.

Further, according to this embodiment, the pulse tube refrigerator 10 includes an introduction pipe 15 for introducing a gas regenerator material into the internal space of a low-temperature-side second stage regenerator tube 32 (to be described below) of the second-stage regenerator tube 22. The introduction pipe 15 has a first end branching from the high-pressure pipe 13 that defines the outlet side of the compressor 11 and has a second end connected to the low-temperature-side second stage regenerator tube 32.

The valve unit 12 includes valves V1, V2, V3, V4, V5, and V6. The valve unit 12 is connected between the compressor 11 and the expander 20, and causes the high-pressure pipe 13, defining the outlet side of the compressor 11, and the low-pressure pipe 14, defining the intake side of the compressor 11, to alternately communicate with the expander 20. The valve 1 allows or blocks communication between the high-pressure pipe 13 and the first-stage regenerator tube 21. The valve 2 allows or blocks communication between the low-pressure pipe 14 and the first-stage regenerator tube 21. The valve 3 allows or blocks communication between the high-pressure pipe 13 and the first-stage pulse tube 23. The valve 4 allows or blocks communication between the low-pressure pipe 14 and the first-stage pulse tube 23. The valve 5 allows or blocks communication between the high-pressure pipe 13 and the second-stage pulse tube 24. The valve 6 allows or blocks communication between the low-pressure pipe 14 and the second-stage pulse tube 24.

The first-stage regenerator tube 21 stores cold (cold heat) generated by repeated adiabatic expansion of the refrigerant gas. The first-stage regenerator tube 21 has its high-temperature end connected to the valve unit 12 and has its low-temperature end connected to the high-temperature end of the second-stage regenerator tube 22 and to the low-temperature end of the first-stage pulse tube 23.

The first-stage regenerator tube 21 is filled inside with a first-stage regenerator material 29. For example, a copper mesh (copper wire processed into a mesh shape) may be used as the first-stage regenerator material 29. Further, thin stainless steel material may be used for the first-stage regenerator tube 21 in order to minimize conduction loss in its axial directions. Examples of stainless steel materials include those indicated by "SUS" according to Japanese Industrial Standards (for example, SUS304).

Like the first-stage regenerator tube 21, the second-stage regenerator tube 22 stores cold (cold heat) generated by repeated adiabatic expansion of the refrigerant gas. The second-stage regenerator tube 22 has its high-temperature end connected to the low-temperature end of the first-stage regenerator tube 21 and has its low-temperature end connected to the low-temperature end of the second-stage pulse tube 24.

A description is given below of a detailed structure of the second-stage regenerator tube 22 using FIG. 2.

The first-stage pulse tube 23 has its high-temperature end connected to the valve unit 12 and has its low-temperature end connected to the low-temperature end of the first-stage regenerator tube 21. In the first-stage pulse tube 23, the refrigerant gas supplied via the first-stage regenerator tube 21 repeats adiabatic expansion so that cold is generated.

The second-stage pulse tube 24 has its high-temperature end connected to the valve unit 12 and has its low-temperature end connected to the low-temperature end of the second-stage regenerator tube 22. Like in the first-stage pulse tube 23, in the second-stage pulse tube 24, the refrigerant gas supplied via the second-stage regenerator tube 22 repeats adiabatic expansion, so that cold is generated. The second-stage pulse tube 24 may correspond to a cylinder according to an aspect of the present invention.

The first-stage pulse tube 23 has flow rectifiers 23*a* and 23*b* at its high-temperature end and low-temperature end, respectively. The second-stage pulse tube 24 has flow rectifiers 24*a* and 24*b* at its high-temperature end and low-temperature end, respectively. The flow rectifiers 23*a*, 23*b*, 24*a* and 24*b* are provided to stabilize the flow of the refrigerant gas generated in the first-stage pulse tube 23 and the second-stage pulse tube 24 by the supplying or the collecting of the refrigerant gas.

The low-temperature end of the first-stage regenerator tube 21 and the low-temperature end of the first-stage pulse tube 23 are fixed to the first-stage cooling stage 25. Cold is conducted from the first-stage pulse tube 23 to the first-stage cooling stage 25 so that the first-stage cooling stage 25 is maintained at low temperature. Further, the high-temperature end of the second-stage regenerator tube 22 as well is fixed to the first-stage cooling stage 25.

The low-temperature end of the second-stage regenerator tube 22 and the low-temperature end of the second-stage pulse tube 24 are fixed to the second-stage cooling stage 26. Cold is conducted from the second-stage pulse tube 24 to the second-stage cooling stage 26 so that the second-stage cooling stage 26 is maintained at cryogenic temperature.

The first orifice 27 is provided between the first-stage pulse tube 23 and the valve unit 12. The second orifice 28 is provided between the second-stage pulse tube 24 and the valve unit 12. Accordingly, the flow rate of the refrigerant gas flowing from the valve unit 12 to the high-temperature end of the first-stage pulse tube 23 and the flow rate of the refrigerant gas flowing from the high-temperature end of the first-stage pulse tube 23 to the valve unit 12 are controlled at the first orifice 27. Further, the flow rate of the refrigerant gas flowing from the valve unit 12 to the high-temperature end of the second-stage pulse tube 24 and the flow rate of the refrigerant gas flowing from the high-temperature end of the second-stage pulse tube 24 to the valve unit 12 are controlled at the second orifice 28.

In the pulse tube refrigerator 10 having the above-described configuration, the operation of opening and closing the valves V1 and V2 accommodated in the valve unit 12 is repeated in such a manner as to cause the open/closed state of the valve 1 and the open/closed state of the valve 2 to be opposite to each other. As a result, the high-temperature end of the first-stage regenerator tube 21 communicates alternately with the high-pressure pipe 13 and the low-pressure pipe 14 (that is, the communication destination of the high-temperature end of the first-stage regenerator tube 21 is switched between the high-pressure pipe 13 and the low-pressure pipe 14). Consequently, the refrigerant gas is periodically supplied to and collected from the first-stage pulse tube 23 communicating with the low-temperature end of the first-stage regenerator tube 21. As a result, the refrigerant gas repeats compression and expansion inside the first-stage pulse tube 23, when cold is generated by adiabatic expansion. Then, the generated cold is accumulated in the first-stage regenerator tube 21, so that the first-stage regenerator tube 21 is cooled on its low-temperature end side.

Further, the second-stage regenerator tube 22, connected to the low-temperature end of the first-stage regenerator tube 21, also communicates alternately with the high-pressure pipe 13 and the low-pressure pipe 14 (that is, the communication destination of the second-stage regenerator tube 22 is switched between the high-pressure pipe 13 and the low-pressure pipe 14). As a result, the refrigerant gas is periodically supplied to and collected from the second-stage pulse tube 24 communicating with the low-temperature end of the second-stage regenerator tube 22. Consequently, the refrigerant gas inside the second-stage pulse tube 24 is repeatedly compressed and expanded, and cold is generated by adiabatic expansion. Then, the generated cold is accumulated in the second-stage regenerator tube 22, so that the second-stage regenerator tube 22 is cooled on its low-temperature end side.

At this point, the flow of the refrigerant gas to and from the high-temperature end of the first-stage pulse tube 23 is controlled using the valves V3 and V4. As a result, the timing of pressure and flow velocity changes inside the first-stage pulse tube 23 is caused to differ from the timing of pressure and flow velocity changes inside the first-stage regenerator tube 21, so that a phase difference increases. This increases the amount of work of cold generation done by the pulse tube refrigerator 10 when the compression and expansion of the refrigerant gas is repeated, so that the pulse tube refrigerator 10 is improved in refrigerating capacity.

Further, the flow of the refrigerant gas to and from the high-temperature end of the second-stage pulse tube 24 is controlled using the valves V5 and V6. As a result, the timing of pressure and flow velocity changes inside the second-stage pulse tube 24 is caused to differ from the timing of pressure and flow velocity changes inside the second-stage regenerator tube 22, so that a phase difference increases. This increases the amount of work of cold generation done by the pulse tube refrigerator 10 when the compression and expansion of the refrigerant gas is repeated, so that the pulse tube refrigerator 10 is improved in refrigerating capacity.

In the pulse tube refrigerator 10 according to this embodiment, for example, helium gas having a pressure of 0.5 MPa to 2.5 MPa may be used as a refrigerant gas, and the compression and expansion of the refrigerant gas is repeated at a repetition rate of, for example, approximately 2 Hz. This allows a low temperature of, for example, approximately 50 K to be attained at the low-temperature end of the first-stage regenerator tube 21 and allows a low temperature of, for example, approximately 4 K to be attained at the low-temperature end of the second-stage regenerator tube 22.

Figure 2:
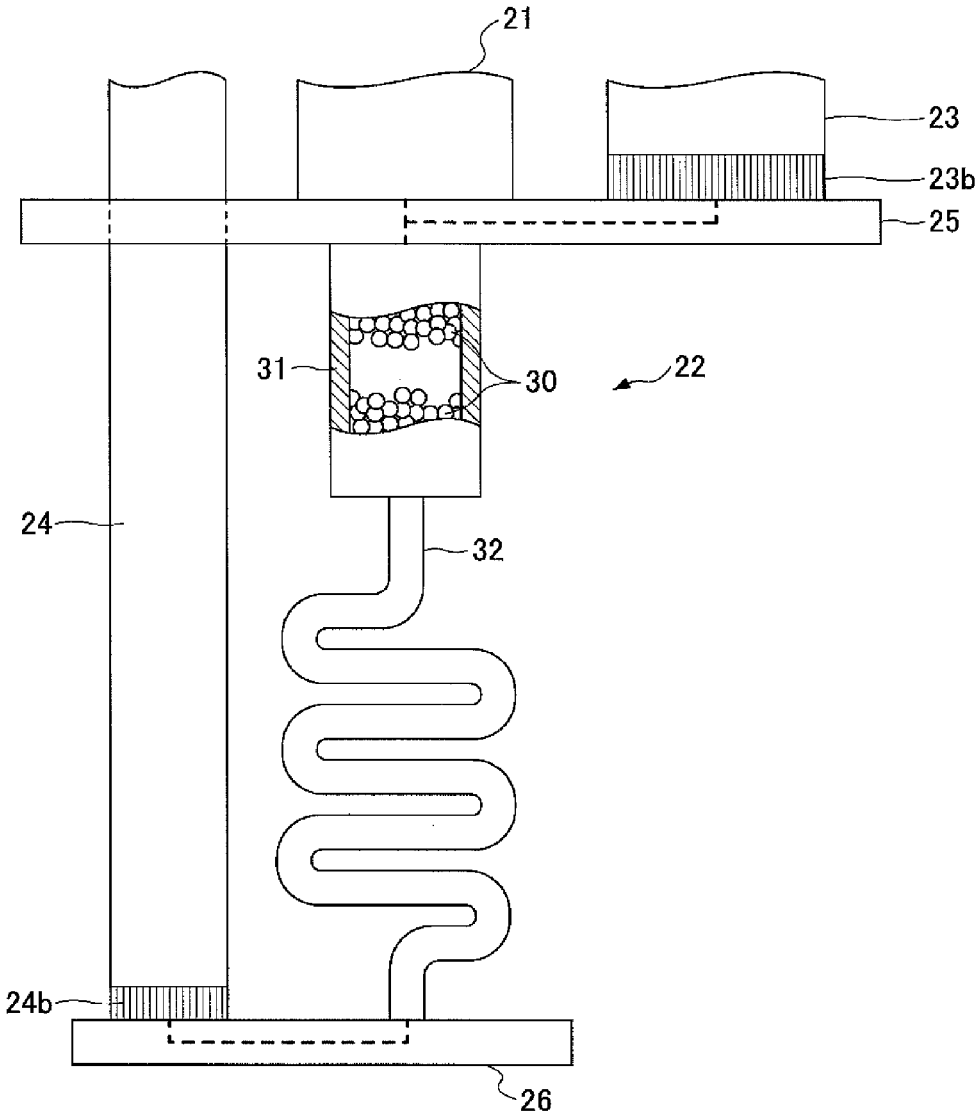
FIG. 2 is a schematic diagram illustrating a configuration of the pulse tube refrigerator around a second-stage regenerator tube according to the first embodiment.
Figure 3A:
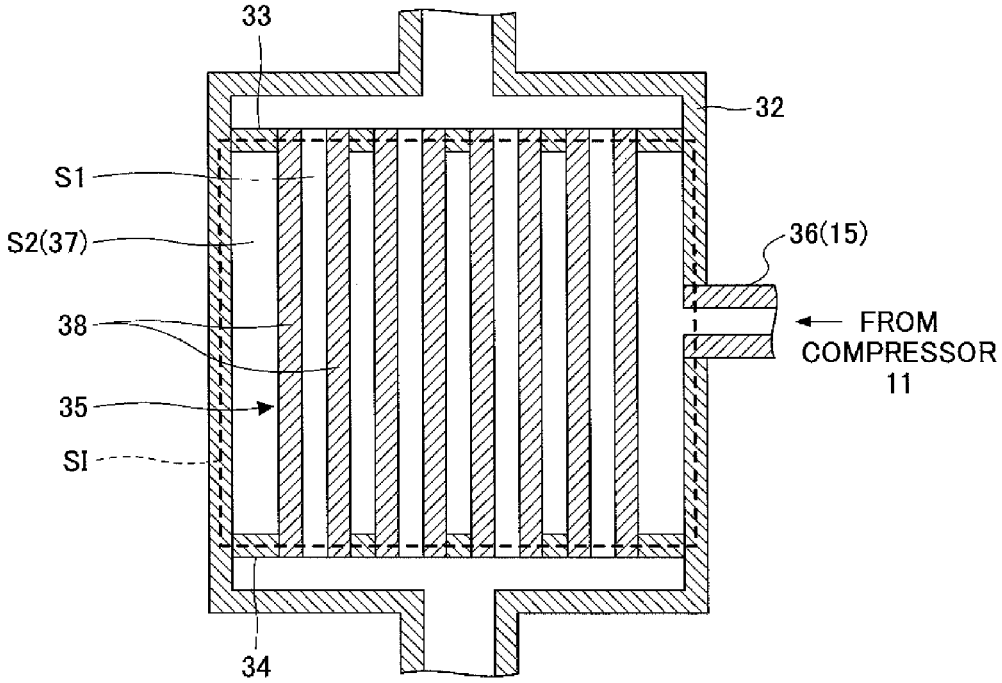
Figure 3B:
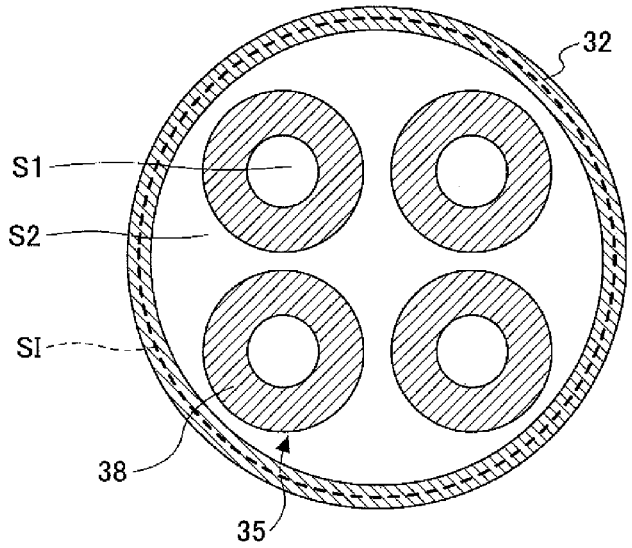
Figure 4:
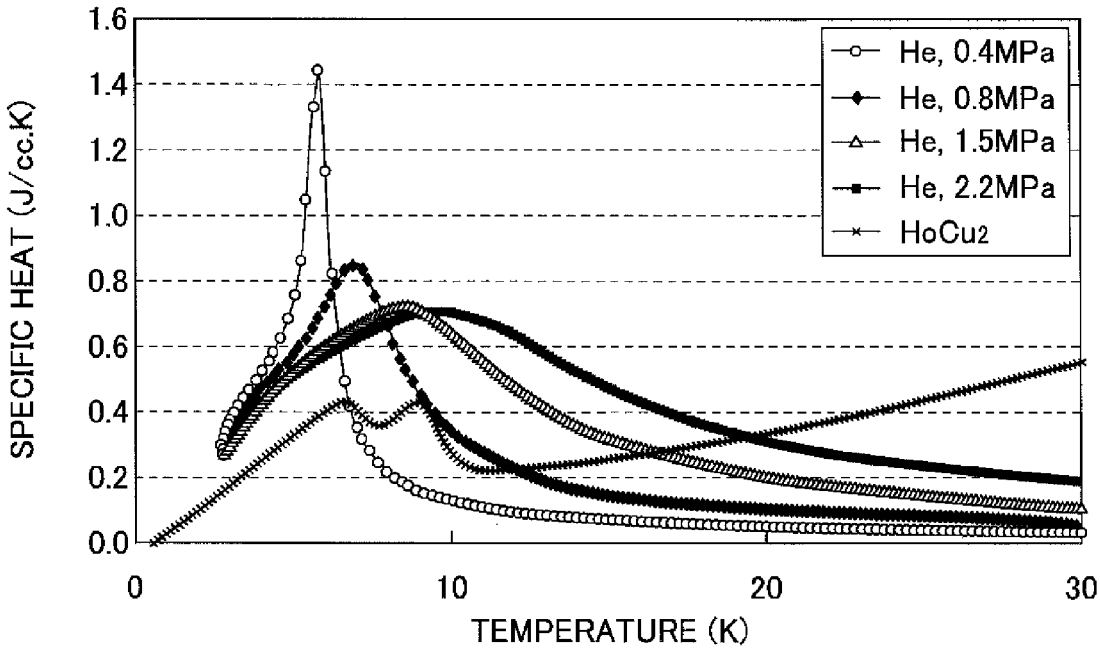
FIG. 4 is a graph illustrating the temperature dependence of the specific heat of helium gas at different pressures in contrast with the temperature dependence of the specific heat of a magnetic regenerator material according to the first embodiment.

FIG. 2 is a schematic diagram illustrating a configuration of the pulse tube refrigerator 10 around the second-stage regenerator tube 22 according to this embodiment. Further, FIGS. 3A and 3B are enlarged cross-sectional views of the low-temperature-side second-stage regenerator tube 32, schematically illustrating a configuration of the low-temperature-side second-stage regenerator tube 32. FIG. 3A is a vertical (longitudinal) cross-sectional view, and FIG. 3B is a horizontal cross-sectional view. FIG. 4 is a graph illustrating the temperature dependence of the specific heat of helium gas at different pressures in contrast with the temperature dependence of the specific heat of a magnetic regenerator material.

The second-stage regenerator tube 22 includes a high-temperature-side second-stage regenerator tube 31 and the low-temperature-side second-stage regenerator tube 32 in this order from the high-temperature side to the low-temperature side (from top to bottom in FIG. 1 and FIG. 2). The low-temperature-side second-stage regenerator tube 32 may correspond to a regenerator tube according to an aspect of the present invention.

The high-temperature-side second-stage regenerator tube 31 has its high-temperature end connected to the low-temperature end of the first-stage regenerator tube 21 and has its low-temperature end connected to the high-temperature end of the low-temperature-side second-stage regenerator tube 32. Further, the high-temperature-side second-stage regenerator tube 31 has its high-temperature end fixed to the first-stage cooling stage 25.

The high-temperature-side second-stage regenerator tube 31 is filled inside with a high-temperature-side second-stage regenerator material 30. Thin stainless steel material may be used for the high-temperature-side second-stage regenerator tube 31 in order to minimize conduction loss in its axial directions. Examples of stainless steel materials include those indicated by "SUS" according to Japanese Industrial Standards for example, SUS304). Further, for example, lead balls may be used as the high-temperature-side second-stage regenerator material 30 because among metals, lead has high specific heat in a temperature range of 15 K to 40 K.

The low-temperature-side second-stage regenerator tube 32 has its high-temperature end connected to the low-temperature end of the high-temperature-side second-stage regenerator tube 31 and has its low-temperature end connected to the low-temperature end of the second-stage pulse tube 24. Further, the low-temperature-side second-stage regenerator tube 32 has its low-temperature end fixed to the second-stage cooling stage 26.

The low-temperature-side second-stage regenerator tube 32 includes a high-temperature-side partitioning member 33, a low-temperature-side partitioning member 34, multiple internal tubes 35, and an inlet 36. The high-temperature-side partitioning member 33 separates an internal space SI of the low-temperature-side second-stage regenerator tube 32 and the high-temperature-side of the low-temperature-side second-stage regenerator tube 32. The low-temperature-side partitioning member 34 separates the internal space SI of the low-temperature-side second-stage regenerator tube 32 and the low-temperature-side of the low-temperature-side second-stage regenerator tube 32.

The internal tubes 35 pass through the high-temperature-side partitioning member 33 and the low-temperature-side partitioning member 34, and have their respective first ends open on the high-temperature side of the high-temperature-side partitioning member 33 and have their respective second ends open on the low-temperature side of the low-temperature-side partitioning member 34. That is, the high-temperature side and the low-temperature side of the low-temperature-side second-stage regenerator tube 32 communicate with each other through the internal tubes 35. FIGS. 3A and 3B are simplified drawings, and the arrangement of the internal tubes 35 is illustrated differently therein for easier understanding. The same applies to FIGS. 6A and 6B and FIGS. 7A and 7B.

Thus, the low-temperature-side second-stage regenerator tube 32 has a so-called tube-in-tube structure where the internal tubes 35 are accommodated inside the low-temperature-side second-stage regenerator tube 32. Further, the inlet 36 allows helium gas to be introduced as a gas regenerator material into the low-temperature-side second-stage regenerator tube 32 from the high-pressure pipe 13 on the outlet side of the compressor 11 through the above-described introduction pipe 15.

The internal tubes 35 may correspond to a tube according to an aspect of the present invention.

Further, the low-temperature-side second-stage regenerator tube 32 having a tube-in-tube structure may have a meandering structure, formed by, for example, bending a long tube at multiple points, as illustrated in FIG. 2. The low-temperature-side second-stage regenerator tube 32 may also have a spiral structure, formed by, for example, spirally bending a long tube. These structures allow the long low-temperature-side second-stage regenerator tube 32 to be provided in a limited distance (space) between the first-stage cooling stage 25 and the second-stage cooling stage 26.

Alternatively, the distance between the first-stage cooling stage 25 and the second-stage cooling stage 26 may be increased so that the low-temperature-side second-stage regenerator tube 32 may have a cylindrical shape that extends vertically without being bent in the middle.

As illustrated in FIGS. 3A and 33, the internal tubes 35 partition the internal space SI of the low-temperature-side second-stage regenerator tube 32 into a first space S1 and a second space S2. The first space S1 is the spaces inside the internal tubes 35. The second space S2 is a space outside the internal tubes 35 inside the low-temperature-side second-stage regenerator tube 32. As described above, the internal tubes 35 pass through the high-temperature-side partitioning member 33 and the low-temperature-side partitioning member 34. Therefore, the first space S1 allows the high-temperature side and the low-temperature side of the low-temperature-side second-stage regenerator tube 32 to communicate with each other. The first space S1 allows, for example, a space defined by the high-temperature end of the low-temperature-side second-stage regenerator tube 32 and the high-temperature-side partitioning member 33 and a space defined by the low-temperature end of the low-temperature-side second-stage regenerator tube 32 and the low-temperature-side partitioning member 34 to communicate with each other. Further, the refrigerant gas flows through the first space S1.

The second space S2 is so formed as to communicate with neither the high-temperature side nor the low-temperature side of the low-temperature-side second-stage regenerator tube 32. That is, the second space S2 is isolated from the high-temperature side and the low-temperature side of the low-temperature-side second-stage regenerator tube 32 (isolated from, for example, a space defined by the high-temperature end of the low-temperature-side second-stage regenerator tube 32 and the high-temperature-side partitioning member 33 and a space defined by the low-temperature end of the low-temperature-side second-stage regenerator tube 32 and the low-temperature-side partitioning member 34).

The second space S2 is filled with a low-temperature-side second-stage regenerator material 37. For example, a gas regenerator material formed of gas such as helium gas may be used as the low-temperature-side second-stage regenerator material 37. As illustrated in FIG. 4, for example, under a pressure of 1.5 MPa and in a temperature range of 5K to 15K, helium gas has higher specific heat than HoCu2, which is a magnetic regenerator material having high specific heat at low temperatures.

The shape of a cross section of the low-temperature-side second-stage regenerator tube 32 perpendicular to its axial directions may be, for example, 12 mm in outside diameter and 10 mm in inside diameter. Further, the shape of a cross section of the internal tube 35 perpendicular to its axial directions may be, for example, 1.0 mm in outside diameter and 0.8 mm in inside diameter.

Next, a description is given of the improvement effect on the heat exchange between a refrigerant gas and a gas regenerator material according to this embodiment.

Figure 5:
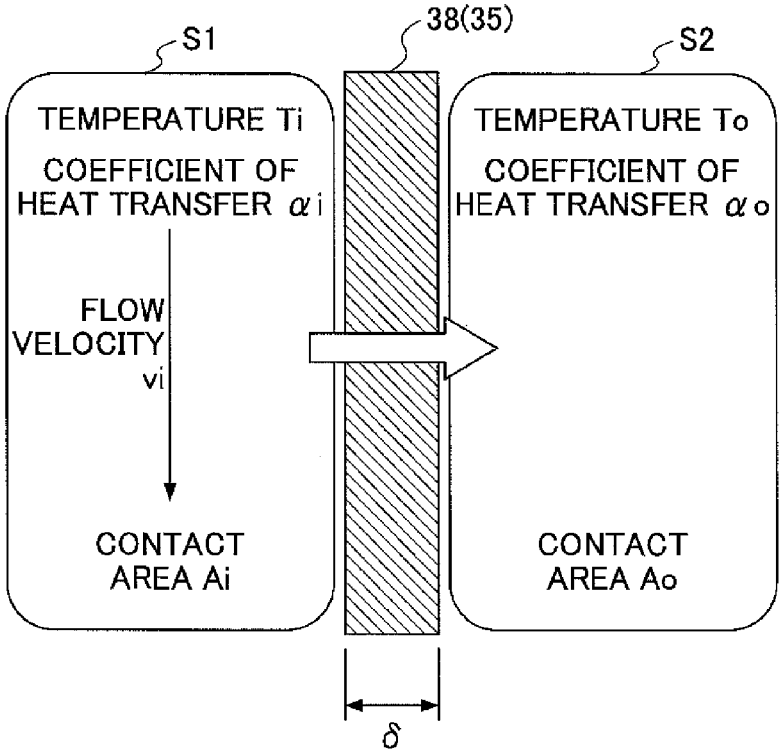
FIG. 5 is a schematic diagram illustrating heat exchange through a tube wall of an internal tube according to the first embodiment.

FIG. 5 is a schematic diagram illustrating heat exchange through a tube wall 38 of the internal tube 35.

In general, letting the coefficient of heat transfer of flowing gas and the Reynolds number of the flowing gas be $\alpha$ and Re, respectively, the following relation is satisfied:

$$\alpha \propto Re^{0.8} \quad (1)$$

Further, letting it be assumed that gas flows at a flow velocity v, the Reynolds number Re satisfies the following relation:

$$Re \propto v. \quad (2)$$

Here, it is assumed that a refrigerant gas flows at a flow velocity vi on the left side of the tube wall 38 while the right side of the tube wall 38 is filled with a gas regenerator material at a flow velocity vo (equals zero). Then, it is assumed that the temperature of the refrigerant gas is Ti, the coefficient of heat transfer of the refrigerant gas is $\alpha i$, and the area of contact of the refrigerant gas with the tube wall 38 is Ai. Further, it is assumed that the temperature of the gas regenerator material is To, the coefficient of heat transfer of the gas regenerator material is $\alpha o$, and the area of contact of the gas regenerator material with the tube wall 38 is Ao. Furthermore, it is assumed that the thickness of the tube wall 38 is $\delta$ and the thermal conductivity of the tube wall 38 is $\lambda$. The area of contact of the refrigerant gas with the tube wall 38, Ai, corresponds to the area of the internal tube 35 exposed to the first space S1. The area of contact of the gas regenerator material with the tube wall 38, Ao, corresponds to the area of the internal tube 35 exposed to the second space S2.

In this case, a thermal resistivity Rt at the time of heat exchange from the refrigerant gas to the gas regenerator material through the tube wall 38 is expressed by:

$$Rt=(1/\alpha i Ai)+(\delta/\lambda)+(1/\alpha o Ao). \quad (3)$$

Based on (1) and (2), the coefficient of heat transfer of the gas regenerator material whose flow velocity vo equals zero, $\alpha o$, is smaller than the coefficient of heat transfer of the refrigerant gas flowing at a flow velocity vi, $\alpha i$. Therefore, conventionally, the third member ($1/\alpha o Ao$) of the right side of Eq. (3) increases, so that the thermal resistivity Rt increases. As a result, it is difficult to improve the efficiency of heat exchange between the refrigerant gas and the gas regenerator material.

On the other hand, according to this embodiment, letting the inside diameter and the outside diameter of the internal tube 35 be r and R (>r), respectively, Ai/Ao=r/R<1. Thus, the area of contact of the gas regenerator material with the tube wall 38, Ao, is greater than the area of contact of the refrigerant gas with the tube wall 38, Ai. Therefore, the third member ($1/\alpha o Ao$) of the right side of Eq. (3) is smaller, so that it is possible to reduce the thermal resistivity Rt. As a result, it is possible to improve the efficiency of heat exchange between the refrigerant gas and the gas regenerator material.

First Variation of First Embodiment

Figure 6A:
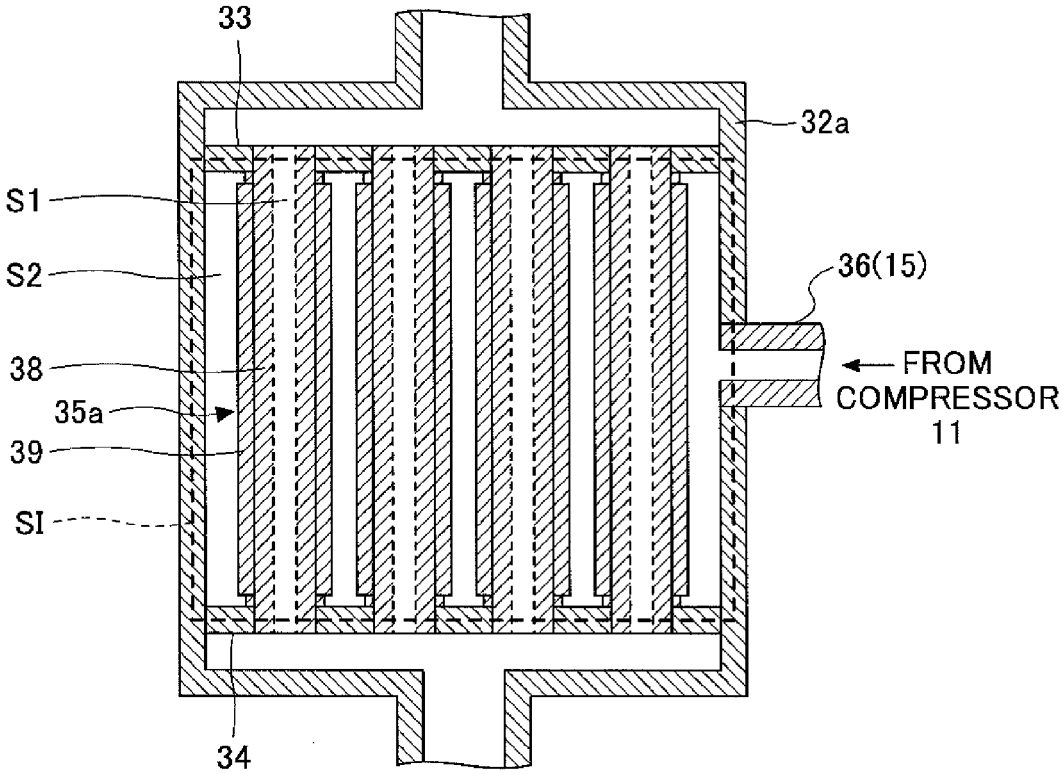
FIGS. 6A and 6B are enlarged cross-sectional views of a low-temperature-side second-stage regenerator tube according to a first variation of the first embodiment, schematically illustrating a configuration of the low-temperature-side second-stage regenerator tube.

Next, a description is given, with reference to FIGS. 6A and 62, of a pulse tube refrigerator according to a first variation of the first embodiment. According to the pulse tube refrigerator of this variation, an internal tube may have a member configured to increase its exterior surface area.

The pulse tube refrigerator according to this variation may have the same configuration as the pulse tube refrigerator 10 of the first embodiment except for a low-temperature-side second-stage regenerator tube 32*a*, and a description of the configuration other than the low-temperature-side second-stage regenerator tube 32*a* is omitted.

Figure 6B:
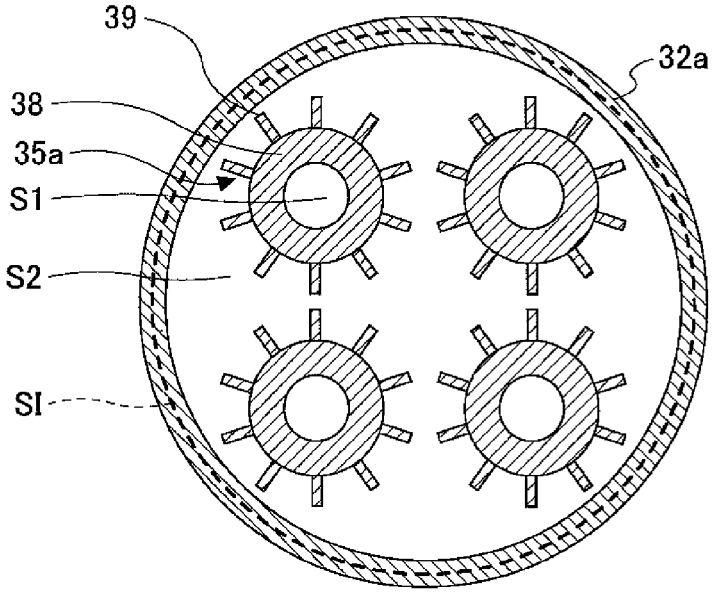

FIGS. 6A and 6B are enlarged cross-sectional views of the low-temperature-side second-stage regenerator tube 32*a*, schematically illustrating a configuration of the low-temperature-side second-stage regenerator tube 32*a*. FIG. 6A is a vertical (longitudinal) cross-sectional view, and FIG. 6B is a horizontal cross-sectional view.

Like the low-temperature-side second-stage regenerator tube 32 of the first embodiment, the low-temperature-side second-stage regenerator tube 32*a* includes the high-temperature-side partitioning member 33, the low-temperature-side partitioning member 34, multiple internal tubes 35*a*, and the inlet 36. The low-temperature-side second-stage regenerator tube 32*a* may have the same structure as the low-temperature-side second-stage regenerator tube 32 of the first embodiment except for the structure of the internal tube 35*a*. Further, the structure where the internal tubes 35*a* partition the internal space SI of the low-temperature-side second-stage regenerator tube 32*a* into the first space S1 and the second space S2 may be the same as a corresponding structure in the first embodiment.

According to this variation, the internal tubes 35*a* have fins 39 as a member configured to increase their exterior surface area. As illustrated in FIG. 6B, the multiple, for example, eight fins 39 may be provided radially on each of the internal tubes 35*a* in a cross-sectional view perpendicular to the length of the internal tubes 35*a*. This makes it possible to further increase the area of contact of the gas regenerator material with the internal tubes, thus making it possible to further improve the efficiency of heat exchange between the refrigerant gas and the gas regenerator material.

The fins 39 may be replaced with various members for increasing the exterior surface area of the internal tubes 35*a*, such as a member with a corrugated surface to be provided on the exterior circumferential surfaces of the internal tubes 35*a*.

Second Variation of First Embodiment

Figure 7A:
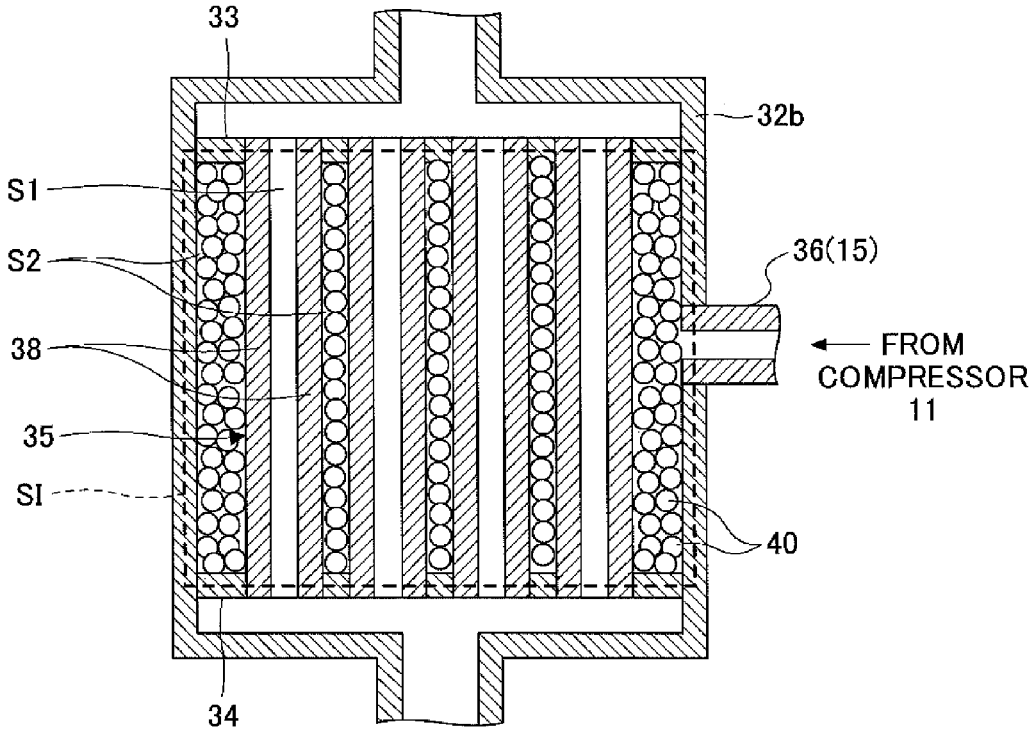
FIGS. 7A and 7B are enlarged cross-sectional views of a low-temperature-side second-stage regenerator tube 32 according to a second variation of the first embodiment, schematically illustrating a configuration of the low-temperature-side second-stage regenerator tube.
Figure 7B:
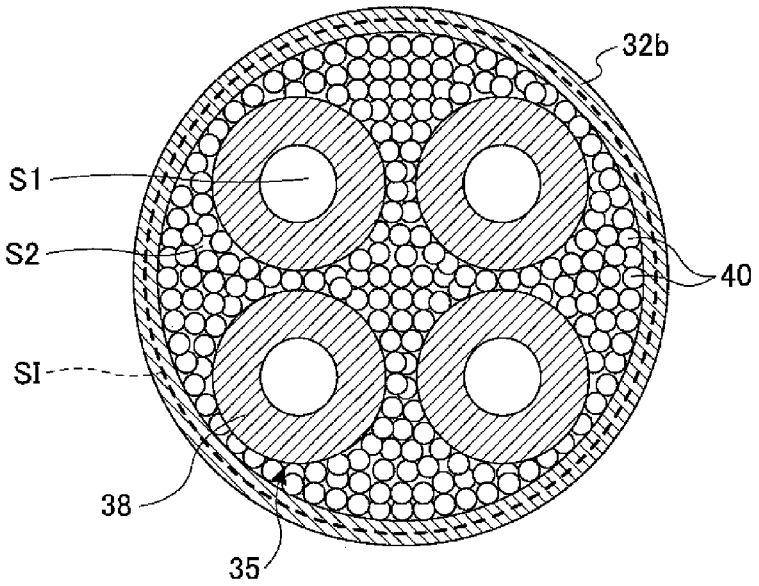

Next, a description is given, with reference to FIGS. 7A and 7B, of a pulse tube refrigerator according to a second variation of the first embodiment. According to the pulse tube refrigerator of this variation, a low-temperature-side second-stage regenerator tube 32*b* may contain a filler formed of metal, with which the second space S2 is filled.

The pulse tube refrigerator according to this variation as well may have the same configuration as the pulse tube refrigerator 10 of the first embodiment except for the low-temperature-side second-stage regenerator tube 32*b*, and a description of the configuration other than the low-temperature-side second-stage regenerator tube 32*b* is omitted.

FIGS. 7A and 7B are enlarged cross-sectional views of the low-temperature-side second-stage regenerator tube 32*b*, schematically illustrating a configuration of the low-temperature-side second-stage regenerator tube 32*b*. FIG. 7A is a vertical (longitudinal) cross-sectional view, and FIG. 7B is a horizontal cross-sectional view.

Like the low-temperature-side second-stage regenerator tube 32 of the first embodiment, the low-temperature-side second-stage regenerator tube 32*b* includes the high-temperature-side partitioning member 33, the low-temperature-side partitioning member 34, the internal tubes 35, and the inlet 36. With respect to their structures, the low-temperature-side second-stage regenerator tube 32*b* may be the same as the low-temperature-side second-stage regenerator tube 32 of the first embodiment. Further, the structure where the internal tubes 35 partition the internal space SI of the low-temperature-side second-stage regenerator tube 32*b* into the first space S1 and the second space S2 may be the same as a corresponding structure in the first embodiment.

According to this variation, the low-temperature-side second-stage regenerator tube 32*b* includes a filler 40 formed of metal, with which the second space S2 is filled. As illustrated in FIGS. 7A and 7B, the metal filler 40 may be an accumulation of metal powder. The filler 40 and the internal tubes 35 are in partial contact. This makes it possible to increase the area of contact of the gas regenerator material and the internal tubes 35 including the filler 40, thus making it possible to improve the efficiency of heat exchange between the refrigerant gas and the gas regenerator material.

Further, according to this variation, the filler 40 may be integrated (formed unitarily) with the internal tubes 35 by various bonding methods such as diffusion bonding and ultrasonic bonding. This further ensures the thermal contact of the filler 40 and the internal tubes 35. Therefore, it is possible to further increase the area of contact of the gas regenerator material and the internal tubes 35 including the filler 40, thus making it possible to further improve the efficiency of heat exchange between the refrigerant gas and the gas regenerator material.

[b] Second Embodiment

Figure 8:
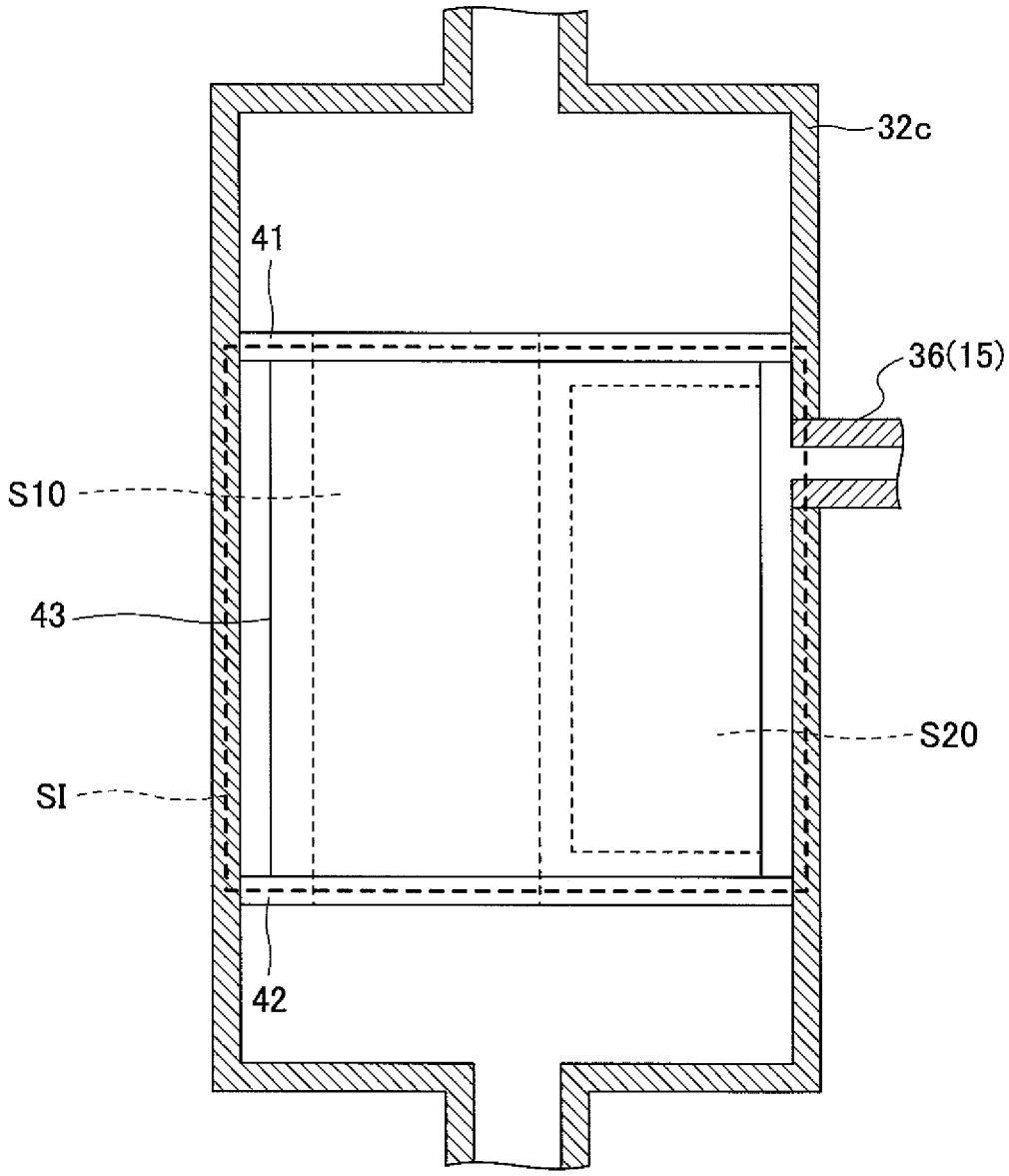
FIG. 8 is an enlarged vertical (longitudinal) cross-sectional view of a low-temperature-side second-stage regenerator tube according to a second embodiment, schematically illustrating a configuration of the low-temperature-side second-stage regenerator tube.
Figure 9:
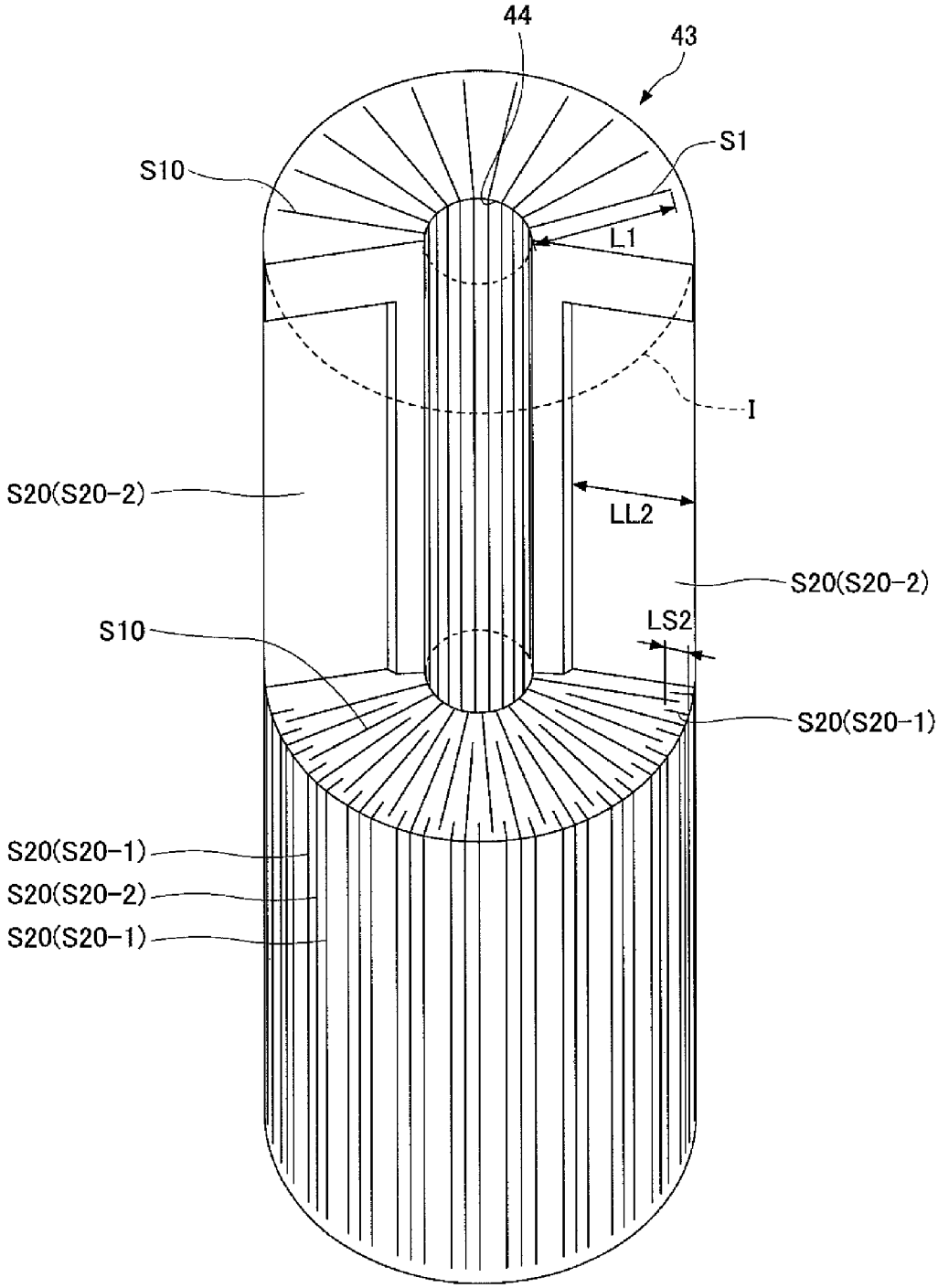
FIG. 9 is a perspective view of the low-temperature-side second-stage regenerator tube according to the second embodiment, illustrating a partitioning member in a partially cut-off state.

Next, a description is given, with reference to FIG. 8 and FIG. 9, of a pulse tube refrigerator according to a second embodiment. According to the pulse tube refrigerator of this embodiment, a low-temperature-side second-stage regenerator tube 32*c* has a slit structure instead of a tube-in-tube structure.

The pulse tube refrigerator according to this embodiment may have the same configuration as the pulse tube refrigerator 10 of the first embodiment except for the low-temperature-side second-stage regenerator tube 32*c*. Therefore, a description of the configuration other than the low-temperature-side second-stage regenerator tube 32*c* is omitted.

FIG. 8 is an enlarged vertical (longitudinal) cross-sectional view of the low-temperature-side second-stage regenerator tube 32*c*, schematically illustrating a configuration of the low-temperature-side second-stage regenerator tube 32*c*. FIG. 9 is a perspective view of the low-temperature-side second-stage regenerator tube 32*c*, illustrating a partitioning member 43 in a partially cut-off state. In FIG. 9, a cut-off portion I of the partitioning member 43 is indicated by a broken line. Further, a graphical representation of seal members is omitted.

According to this embodiment, the low-temperature-side second-stage regenerator tube 32*c* may have a vertically extending cylindrical shape.

The low-temperature-side second-stage regenerator tube 32*c* includes a high-temperature seal member 41, a low-temperature seal member 42, the partitioning member 43, and the inlet 36. The partitioning member 43 has a cylindrical shape. The outside diameter of the partitioning member 43 is smaller than the inside diameter of the low-temperature-side second-stage regenerator tube 32*c*. The partitioning member 43 and the high-temperature-side seal member 41 separate the internal space SI, formed between the inside of the low-temperature-side second-stage regenerator tube 32*c* and the partitioning member 43, and the high-temperature side of the low-temperature-side second-stage regenerator tube 32*c*. The partitioning member 43 and the low-temperature-side seal member 42 separate the internal space SI, formed between the inside of the low-temperature-side second-stage regenerator tube 32*c* and the partitioning member 43, and the low-temperature side of the low-temperature-side second-stage regenerator tube 32*c*.

In the partitioning member 43, first slit spaces S10 and second slit spaces S20 are formed.

The first slit spaces S10 are so formed as to be open at each of the end face at the high-temperature end (high-temperature end face) and the end face at the low-temperature end (low-temperature end face) of the partitioning member 43. That is, the first slit spaces S10 are so formed as to allow the high-temperature side and the low-temperature side of the low-temperature-side second-stage regenerator tube 32*c* to communicate with each other. Further, the first slit spaces S10 have no openings on the exterior circumferential surface of the partitioning member 43. That is, the first slit spaces S10 are so formed as to not communicate with the space between (surrounded by) the interior circumferential surface of the low-temperature-side second-stage regenerator tube 32*c* and the exterior circumferential surface of the partitioning member 43.

As illustrated in FIG. 9, a through hole 44 may be so formed in the partitioning member 43 as to pass through the partitioning member 43 between the high-temperature end face and the low-temperature end face of the partitioning member 43. In this case, the first slit spaces S10 may have openings on the interior circumferential surface of the partitioning member 43 (that is, the first slit spaces S10 may be open to the through hole 44).

On the other hand, the second slit spaces S20 are open on neither the high-temperature end face nor the low-temperature end face of the partitioning member 43. That is, the second slit spaces S20 are so formed as to communicate with neither the high-temperature side nor the low-temperature side of the low-temperature-side second-stage regenerator tube 32*c*. Instead, the second slit spaces S20 have openings on the exterior circumferential surface of the partitioning member 43. That is, the second slit spaces S20 are so formed as to communicate with the space between (surrounded by) the interior circumferential surface of the low-temperature-side second-stage regenerator tube 32*c* and the exterior circumferential surface of the partitioning member 43.

Thus, the low-temperature-side second-stage regenerator tube 32*c* has a slit structure, where slit spaces are formed inside the low-temperature-side second-stage regenerator tube 32*c*. Further, the inlet 36 allows helium gas to be introduced inside as a gas regenerator material from the high-pressure pipe 13 on the outlet side of the compressor 11 through the above-described introduction pipe 15.

As illustrated in FIG. 8 and FIG. 9, the partitioning member 43 partitions the internal space SI of the low-temperature-side second-stage regenerator tube 32*c* into a first space including the first slit spaces S10 and a second space including the second slit spaces S20 and the space surrounded (defined by) the interior circumferential surface of the low-temperature-side second-stage regenerator tube 32*c*, the exterior circumferential surface of the partitioning member 43, the high-temperature-side seal member 41, and the low-temperature-side seal member 42. Further, a refrigerant gas flows through the first space.

The shape of a cross section of the low-temperature-side second-stage regenerator tube 32*c* perpendicular to its axial directions may be, for example, 32 mm in outside diameter and 30 mm in inside diameter. Further, the shape of a cross section of the partitioning member 43 perpendicular to its axial directions may be, for example, 29.5 mm in outside diameter.

According to this embodiment, the area of the partitioning member 43 exposed to the second slit spaces S20 is greater than the area of the partitioning member 43 exposed to the first slit spaces S10. This allows the area of contact of the gas regenerator material and the partitioning member to be greater than the area of contact of the refrigerant gas and the partitioning member 43, thus making it possible to improve the efficiency of heat exchange between the refrigerant gas and the gas regenerator material.

In the case illustrated in FIG. 9, the second slit spaces S20 include two kinds of slit spaces S20-1 and S20-2 having different lengths in the radial directions of the partitioning member 43. The number of the shorter slit spaces S20-1 formed is twice the number of the longer slit spaces S20-2 formed. A set of slit spaces, formed of one first slit space S10, one longer second slit space S20-2, and two shorter second slit spaces S20-1, is repeatedly formed along the circumferential directions of the partitioning member 43 so that the slit spaces S10, S20-2, and S20-1 are arranged radially. Here, the area of the partitioning member 43 exposed to the first slit spaces S10 may be represented by a radial length L1 of the partitioning member 43 in the first slit spaces S10. Further, the area of the partitioning member 43 exposed to the second slit spaces S20 may be represented by the sum of a radial length LL2 of the longer second slit spaces S20-2 and the double of a radial length LS2 of the shorter second slit spaces S20-1, (LL2 LS2×2). In this case, LL2+LS2×2 may be greater than L1.

As long as the area of the partitioning member 43 exposed to the second slit spaces S20 is greater than the area of the partitioning member 43 exposed to the first slit spaces S10, the first slit spaces S10 and the second slit spaces S20 may take various shapes other than those illustrated in FIG. 9.

[c] Third Embodiment

Figure 10:
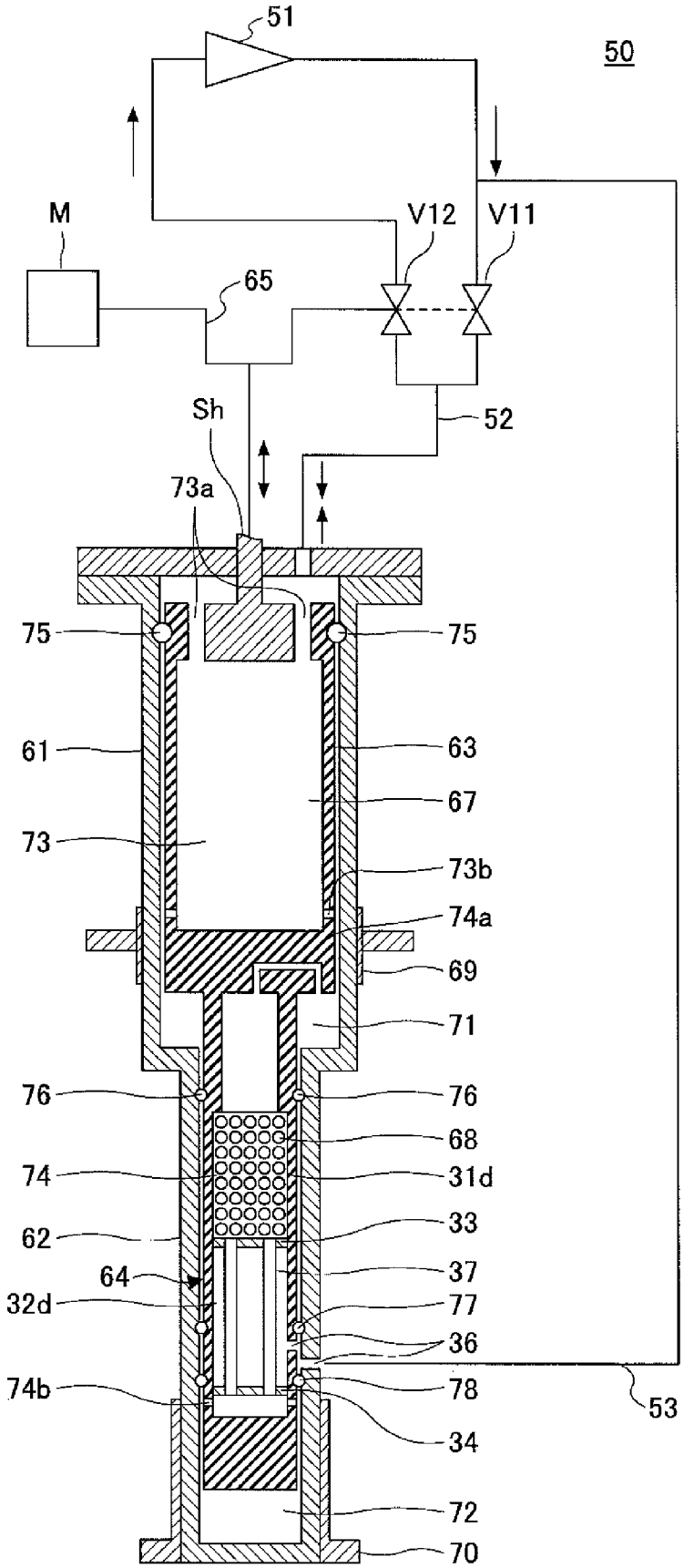
FIG. 10 is a schematic cross-sectional view of a GM refrigerator according to a third embodiment, illustrating a configuration of the GM refrigerator.
Figure 11:
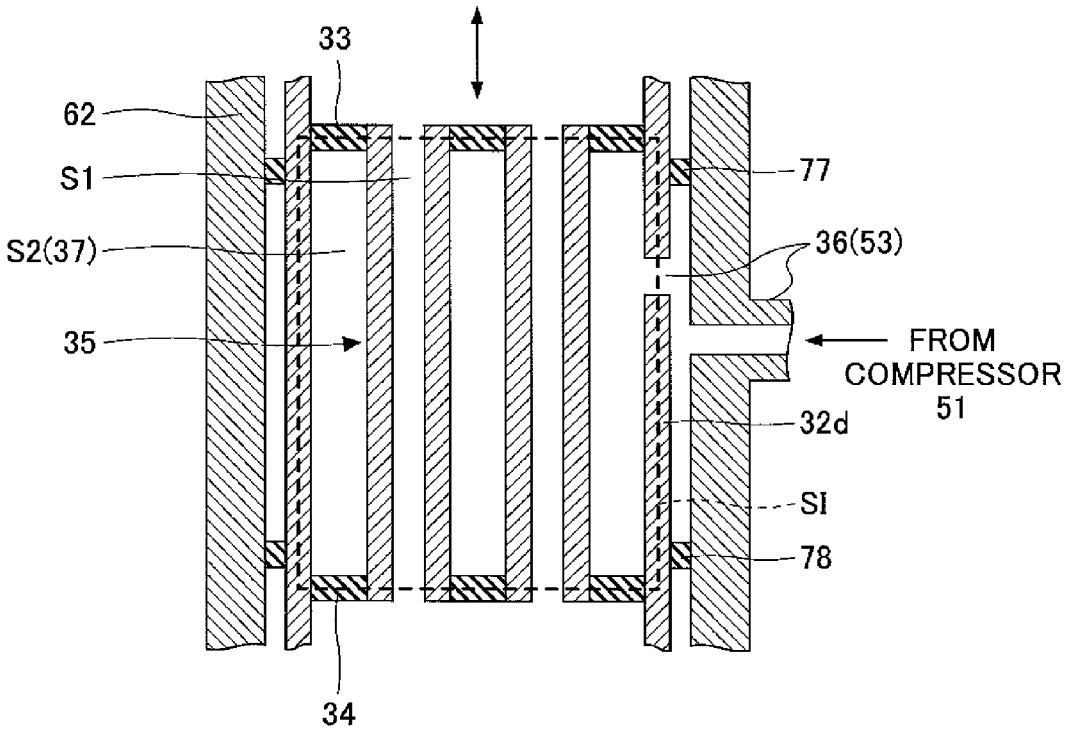
FIG. 11 is an enlarged vertical (longitudinal) cross-sectional view of a low-temperature-side second-stage regenerator tube according to the third embodiment, schematically illustrating a configuration of the low-temperature-side second-stage regenerator tube.

Next, a description is given, with reference to FIG. 10 and FIG. 11, of a GM refrigerator according to a third embodiment. This GM refrigerator, which is an application of a regenerative refrigerator of the present invention to a GM refrigerator, has a two-stage configuration suitable for attaining cryogenic temperatures of approximately a few K to approximately 20 K. In the third embodiment, the same elements as those described above are referred to by the same reference numerals.

FIG. 10 is a schematic cross-sectional view of a GM refrigerator 50 according to this embodiment, illustrating a configuration of the GM refrigerator 50. FIG. 11 is an enlarged vertical (longitudinal) cross-sectional view of a low-temperature-side second-stage regenerator tube, schematically illustrating a configuration of the low-temperature-side second-stage regenerator tube.

The GM refrigerator 50 includes a compressor 51, a refrigerant gas passage 52, a first-stage cylinder 61, a second-stage cylinder 62, a first-stage displacer 63, a second-stage displace 64, a crank mechanism 65, regenerator materials 67 and 68, heat stations 69 and 70, expansion spaces 71 and 72, and hollow (internal) spaces (refrigerant gas passages) 73 and 74.

The compressor 51 generates high-pressure helium gas by compressing helium gas (refrigerant gas) to approximately 20 $Kgf/cm^2$. The generated high-pressure helium gas is supplied into the first-stage cylinder 61 through an intake valve V11 and the refrigerant gas passage 52. Further, low-pressure helium gas discharged from the first-stage cylinder 61 is collected into the compressor 51 via the refrigerant gas passage 52 and an exhaust valve V12.

Further, according to this embodiment, the GM refrigerator 50 includes an introduction pipe 53 for introducing a gas regenerator material into the internal space of the second-stage displacer 64. The introduction pipe 53 has a first end branching from the outlet (discharge) side of the compressor 51 and has a second end connected to a low-temperature-side second stage regenerator tube 32*d* (to be described below) of the second-stage displacer 64.

The second-stage cylinder 62 is joined to the first-stage cylinder 61. The first-stage displacer 63 and the second-stage displacer 64, which are joined to each other, are accommodated in the first-stage cylinder 61 and the second-stage cylinder 62, respectively.

A drive shaft Sh extends upward from the first-stage cylinder 61 to be joined to the crank mechanism 65 which is joined to a drive motor M.

The first-stage displacer 63 is so provided inside the first-stage cylinder 61 as to be reciprocatable along the first-stage cylinder 61. The first-stage displacer 63 defines the expansion space 71 at one end of the first-stage cylinder 61. The first-stage displacer 63 has the shape of a solid of revolution.

Further, the hollow space (refrigerant gas passage) 73 for supplying the refrigerant gas to and discharging the refrigerant gas from the expansion space 71 is formed inside the first-stage displacer 63. A seal member 75 such as a piston ring is provided between the exterior circumferential surface of the first-stage displacer 63 and the interior circumferential surface of the first-stage cylinder 61. The first-stage displacer 63 causes cold to be generated by causing the refrigerant gas supplied to the expansion space 71 to expand when reciprocating along the first-stage cylinder 61.

The regenerator material 67 is contained inside the hollow space 73. The regenerator material 67 accumulates cold by coming into contact with the discharged refrigerant gas when the refrigerant gas is discharged from the expansion space 71. That is, the regenerator material 67 stores cold generated by the first-stage displacer 63 causing the refrigerant gas supplied to the expansion space 71 to expand when reciprocating along the first-stage cylinder 61.

The second-stage displacer 64 is so provided inside the second-stage cylinder 62 as to be reciprocatable along the second-stage cylinder 62. The second-stage displacer 64 defines the expansion space 72 at one end of the second-stage cylinder 62. The second-stage displacer 64 has the shape of a solid of revolution.

Further, the hollow space (refrigerant gas passage) 74 for supplying the refrigerant gas to and discharging the refrigerant gas from the expansion space 72 is formed inside the second-stage displacer 64. A seal member 76 such as a piston ring is provided between the exterior circumferential surface of the second-stage displacer 64 and the interior circumferential surface of the second-stage cylinder 62. The second-stage displacer 64 causes cold to be generated by causing the refrigerant gas supplied to the expansion space 72 to expand when reciprocating along the second-stage cylinder 62.

Seal members 77 and 78 such as piston rings are also provided between the exterior circumferential surface of the low-temperature-side second stage regenerator tube 32*d* of the second-stage displacer 64 and the interior circumferential surface of the second-stage cylinder 62. The seal members 77 and 78 are provided on the high-temperature side and the low-temperature side, respectively, of part of the inlet 36 in the second-stage cylinder 62 as a center. The introduction pipe 53 is connected to the inlet 36.

The regenerator material 68 is contained inside the hollow space 74. The regenerator material 68 accumulates cold by coming into contact with the discharged refrigerant gas when the refrigerant gas is discharged from the expansion space 72. That is, the regenerator material 68 stores cold generated by the second-stage displacer 64 causing the refrigerant gas supplied to the expansion space 72 to expand when reciprocating along the first-stage cylinder 62.

The first-stage heat station 69 is thermally coupled to the first-stage cylinder 61 so as to surround the lower end (low-temperature end) of the first-stage cylinder 61. The second-stage heat station 70 is thermally coupled to the second-stage cylinder 62 so as to surround the lower end (low-temperature end) of the second-stage cylinder 62.

The first-stage cylinder 61 and the second-stage cylinder 62 are preferably formed of, for example, stainless steel (such as SUS304) or the like. This allows the first-stage cylinder 61 and the second-stage cylinder 62 to have high strength, low thermal conductivity, and high helium gas shielding capability.

The first-stage displacer 63 and the second-stage displacer 64 are preferably formed of, for example, fabric-containing phenolic resin (Bakelite) or the like. This allows the first-stage displacer 63 and the second-stage displacer 64 to be reduced in weight, better in wear resistance and strength, and reduce the amount of heat entering the low-temperature side from the high-temperature side.

The first-stage regenerator material 67 is preferably formed of, for example, a wire mesh or the like, and the second-stage regenerator material 68 is preferably formed of, for example, lead balls or the like as described below. This makes it possible to ensure sufficiently high heat capacity in a low temperature range.

In the GM refrigerator 50 thus configured, cold is generated as follows.

High-pressure refrigerant helium gas supplied from the compressor 51 via the intake valve 11 is supplied into the first-stage cylinder 61 via the refrigerant gas passage 52. The high-pressure helium gas passes through an opening (refrigerant gas passage) 73*a*, the hollow space (refrigerant gas passage) 73 containing the regenerator material 67, and an opening (refrigerant gas passage) 73*b* to be supplied to the first-stage expansion space 71.

The high-pressure helium gas supplied to the first-stage expansion space 71 further passes through an opening (refrigerant gas passage) 74*a*, the hollow space (refrigerant gas passage) 74 containing the regenerator material 68, and an opening (refrigerant gas passage) 74*b* to be supplied to the second-stage expansion space 72.

When the intake valve V11 is closed and the exhaust valve V12 is opened, the high-pressure helium gas in the second-stage cylinder 62 and the first-stage cylinder 61 follows the intake path in the reverse direction to be collected into the compressor 51 through the refrigerant gas passage 52 and the exhaust valve V12.

When the GM refrigerator 50 is in operation, the rotational driving force of the drive motor M is converted into the reciprocating driving force of the drive shaft Sh by the crank mechanism 65. The drive shaft Sh causes the first-stage displacer 63 and the second-stage displacer 64 to vertically reciprocate (along the first-stage cylinder 61 and the second-stage cylinder 62, respectively) as indicated by a double-headed arrow in FIG. 10.

When the first-stage displacer 61 and the second-stage displacer 62 are driven in a direction away from the drive shaft Sh (downward in FIG. 10) by the drive shaft Sh, the intake valve V11 is opened and the exhaust valve V12 is closed to allow high-pressure helium gas to be supplied into the expansion space 71 inside the first-stage cylinder 61 and the expansion space 72 inside the second-stage cylinder 62 (a supply process).

Further, when the first-stage displacer 63 and the second-stage displacer 64 are driven in a direction toward the drive shaft Sh (upward in FIG. 10) by the drive shaft Sh, the intake valve V11 is closed and the exhaust valve V12 is opened. The pressure of the expansion space 71 inside the first-stage cylinder 61 and the pressure of the expansion space 72 inside the second-stage cylinder 62 are reduced, and the helium gas is discharged from the expansion space 71 and the expansion space 72 to be collected into the compressor 51 (a discharge process).

At this point, the helium gas expands to generate cold in the expansion spaces 71 and 72. The helium gas, having generated cold and been cooled, cools the regenerator materials 67 and 68 by coming into contact and exchanging heat with the regenerator materials 67 and 68 when being discharged from the expansion spaces 71 and 72. That is, the generated cold is accumulated in the regenerator materials 67 and 68.

High-pressure helium gas supplied in the subsequent supply process is cooled by being supplied through the regenerator materials 67 and 68. The cooled helium gas is further cooled through its expansion in the expansion spaces 71 and 72.

By repeating the supply process and the discharge process as described above, the expansion space 71 inside the first-stage cylinder 61 is cooled to temperatures of, for example, approximately 40 K to approximately 70 K, and the expansion space 72 of the second-stage cylinder 62 is cooled to temperatures of, for example, approximately a few K to approximately 20 K.

Next, a description is given of the second-stage displacer 64.

The second-stage displacer 64 includes a high-temperature-side second-stage regenerator tube 31*d* and the low-temperature-side second-stage regenerator tube 32*d* in this order from the high-temperature side to the low-temperature side (from top to bottom in FIG. 10). The low-temperature-side second-stage regenerator tube 32*d* may correspond to a regenerator tube according to an aspect of the present invention.

The high-temperature-side second-stage regenerator tube 31*d* has its high-temperature end connected to the low-temperature end of the first-stage displacer 63 and has its low-temperature end connected to the high-temperature end of the low-temperature-side second-stage regenerator tube 32*d*.

As described above, the high-temperature-side second-stage regenerator tube 31*d* is filled inside with the regenerator material 68. Thin stainless steel material may be used for the high-temperature-side second-stage regenerator tube 31*d* in order to minimize conduction loss in its axial directions. Examples of stainless steel materials include those indicated by "SUS" according to Japanese Industrial Standards (for example, SUS304). Further, for example, lead balls may be used as the regenerator material 68.

The low-temperature-side second-stage regenerator tube 32*d* has its high-temperature end connected to the low-temperature end of the high-temperature-side second-stage regenerator tube 31*d*.

The low-temperature-side second-stage regenerator tube 32*d* may have the same configuration as the low-temperature-side second-stage regenerator tube 32 of the first embodiment. That is, the low-temperature-side second-stage regenerator tube 32*d* includes the high-temperature-side partitioning member 33, the low-temperature-side partitioning member 34, the internal tubes 35, and the inlet 36. The high-temperature-side partitioning member 33 separates the internal space SI of the low-temperature-side second-stage regenerator tube 32*d* and the high-temperature-side of the low-temperature-side second-stage regenerator tube 32*d*. The low-temperature-side partitioning member 34 separates the internal space SI of the low-temperature-side second-stage regenerator tube 32*d* and the low-temperature-side of the low-temperature-side second-stage regenerator tube 32.

The internal tubes 35 pass through the high-temperature-side partitioning member 33 and the low-temperature-side partitioning member 34, and have their respective first ends open on the high-temperature side of the high-temperature-side partitioning member 33 and have their respective second ends open on the low-temperature side of the low-temperature-side partitioning member 34. That is, the high-temperature side and the low-temperature side of the low-temperature-side second-stage regenerator tube 32*d* communicate with each other through the internal tubes 35.

Thus, the low-temperature-side second-stage regenerator tube 32*d* has a so-called tube-in-tube structure where the internal tubes 35 are accommodated inside the low-temperature-side second-stage regenerator tube 32*d*. Further, the inlet 36, which is provided through the second-stage cylinder 62 and the tube wall of the low-temperature-side second-stage regenerator tube 32*d*, allows helium gas to be introduced as a gas regenerator material into the low-temperature-side second-stage regenerator tube 32*d* from the outlet (discharge) side of the compressor 51 through the above-described introduction pipe 53.

In this embodiment as well, as illustrated in FIG. 10 and FIG. 11, the low-temperature-side second-stage regenerator tube 32*d* may have a cylindrical shape that extends vertically without being bent in the middle. Alternatively, as described in the first embodiment with reference to FIG. 2, the low-temperature-side second-stage regenerator tube 32*d* may have a meandering structure, formed by, for example, bending a long tube at multiple points.

In this embodiment as well, the internal tubes 35 partition the internal space SI of the low-temperature-side second-stage regenerator tube 32*d* into the first space S1 and the second space S2. The first space S1 is the spaces inside the internal tubes 35. The second space S2 is a space outside the internal tubes 35 inside the low-temperature-side second-stage regenerator tube 32*d*. As described above, the internal tubes 35 pass through the high-temperature-side partitioning member 33 and the low-temperature-side partitioning member 34. Therefore, the first space S1 allows the high-temperature side and the low-temperature side of the low-temperature-side second-stage regenerator tube 32*d* to communicate with each other. Further, the refrigerant gas flows through the first space S1.

The second space S2 is filled with the low-temperature-side second-stage regenerator material 37. For example, a gas regenerator material formed of gas such as helium gas may be used as the low-temperature-side second-stage regenerator material 37. For example, under a pressure of 1.5 MPa and in a temperature range of 5K to 15K, helium gas has higher specific heat than HoCu2, which is a magnetic regenerator material having high specific heat at low temperatures.

In this embodiment, like in the first embodiment, the area of contact of the gas regenerator material with the tube walls of the internal tubes 35 is greater than the area of contact of the refrigerant gas with the tube walls of the internal tubes 35. This makes it possible to reduce heat resistance at the time of heat exchange between the refrigerant gas and the gas regenerator material, thus making it possible to improve the efficiency of heat exchange between the refrigerant gas and the gas regenerator material.

In this embodiment, like in the first variation of the first embodiment, the internal tubes 35 may have a member configured to increase their exterior surface area. Further, like in the second variation of the first embodiment, the low-temperature-side second-stage regenerator tube 32*d* may contain a filler formed of metal that fills in the second space S2. Further, like in the second embodiment, the low-temperature-side second-stage regenerator tube 32*d* may have a slit structure instead of a tube-in-tube structure.

All examples and conditional language recited herein are intended for pedagogical purposes to aid the reader in understanding the invention and the concepts contributed by the inventors to furthering the art, and are to be construed as being without limitation to such specifically recited examples and conditions, nor does the organization of such examples in the specification relate to a showing of the superiority or inferiority of the invention. Although the embodiments of the present inventions have been described in detail, it should be understood that various changes, substitutions, and alterations could be made hereto without departing from the spirit and scope of the invention.

What is claimed is:

1. A regenerative refrigerator, comprising:

a regenerator tube including a partitioning member, the partitioning member partitioning an internal space of the regenerator tube into a first space that is connected to a compressor and in which a refrigerant gas supplied from a discharge side of the compressor flows and a second space connected to the discharge side of the compressor and filled with the refrigerant gas introduced from the compressor as a regenerator material; and a cylinder connected to the regenerator tube and configured to cause the refrigerant gas supplied via the regenerator tube to adiabatically expand, wherein an area of exposure of the partitioning member to the second space is greater than an area of exposure of the partitioning member to the first space, wherein the partitioning member includes one or more tubes causing a high-temperature side and a low-temperature side of the regenerator tube to communicate with each other, wherein the first space is inside the one or more tubes, and the second space is outside the one or more tubes and is prevented from communicating with each of the high-temperature side and the low-temperature side of the regenerator tube, and wherein the regenerator tube is configured to accumulate, in the regenerator material, cold generated in the cylinder with the adiabatic expansion of the refrigerant gas.

2. The regenerative refrigerator as claimed in claim 1, wherein:

the second space is filled with the filler.

3. The regenerative refrigerator as claimed in claim 1, wherein the one or more tubes are arranged to extend parallel to each other.

4. The regenerative refrigerator as claimed in claim 3, wherein the one or more tubes are arranged at equal intervals.

5. The regenerative refrigerator as claimed in claim 1, further comprising:

a filler that is an accumulation of metal powder, wherein the accumulation of metal powder is diffusion-bonded to the one or more tubes.

* * * * *